US006547715B1

(12) United States Patent
Müller et al.

(10) Patent No.: US 6,547,715 B1
(45) Date of Patent: Apr. 15, 2003

(54) ARRANGEMENT FOR MECHANICAL COUPLING OF A DRIVER TO A COUPLING SITE OF THE OSSICULAR CHAIN

(75) Inventors: Gerd M Müller, Lohhof (DE); Hans Leysieffer, Taufkirchen (DE)

(73) Assignee: Phonak AG, Stafa (CH)

( * ) Notice: Subject to any disclaimer, the term of this patent is extended or adjusted under 35 U.S.C. 154(b) by 310 days.

(21) Appl. No.: 09/613,560

(22) Filed: Jul. 10, 2000

(30) Foreign Application Priority Data

Jul. 8, 1999 (DE) ..... 199 31 788

(51) Int. Cl.[7] ..... H04R 25/00
(52) U.S. Cl. ..... 600/25
(58) Field of Search ..... 600/25; 607/55–57; 381/312–326

(56) References Cited

U.S. PATENT DOCUMENTS

| | | | | |
|---|---|---|---|---|
| 3,712,962 A | | 1/1973 | Epley | |
| 3,870,832 A | | 3/1975 | Fredrickson | |
| 3,882,285 A | | 5/1975 | Nunley et al. | |
| 4,756,312 A | * | 7/1988 | Epley | 381/312 |
| 4,850,962 A | | 7/1989 | Schaefer | |
| 4,988,333 A | * | 1/1991 | Engebretson et al. | 600/25 |
| 5,015,224 A | | 5/1991 | Maniglia | |
| 5,015,225 A | | 5/1991 | Hough et al. | |
| 5,277,694 A | | 1/1994 | Leysieffer et al. | |
| 5,282,858 A | * | 2/1994 | Bisch et al. | 381/162 |

(List continued on next page.)

FOREIGN PATENT DOCUMENTS

| | | |
|---|---|---|
| EP | 0 984 663 | 3/2000 |
| EP | 0 984 665 | 3/2000 |
| WO | WO 98/06235 | 2/1998 |
| WO | WO 98/06236 | 2/1998 |
| WO | WO 98/06237 | 2/1998 |
| WO | WO 98/06238 | 2/1998 |

OTHER PUBLICATIONS

H.P. Zenner, et al., Active Electronic Hearing Implants for Labyrinthine and Conduction Deafness—A New Era of Ear Surgery, HNO 1997—vol. 45, Oct. 1997, pp. 749–774.
H. Leysieffer et al., An Implantable Piezoelectric Hearing aid Converter for Patients with Labyrinthine Deafness, HNO 1997—vol. 45, Oct. 1997, pp. 792–800.
R. Lehner et al., Cold–Flowing Elements for Coupling of an Implantable Hearing Aid Converter to Auditory Ossicle or Perilymph, HNO 1998—vol. 46, Jan. 1998, pp. 27–37.
H. Leysieffer et al., Ein Vollständig Implantierbares Hoörsystem Für Innenohrschwerhörige: TICA LZ 3001, HNO 1998, vol. 46, Oct. 1998, pp. 853–863.

(List continued on next page.)

*Primary Examiner*—Max F. Hindenburg
*Assistant Examiner*—Joseph A. Cadugan
(74) *Attorney, Agent, or Firm*—Nixon Peabody LLP; David S. Safran

(57) ABSTRACT

Implantable arrangement for mechanical coupling of an output-side driver part of an active or passive hearing system, the driver part having a capacity to be excited to mechanical vibrations, to a preselected coupling site on the ossicular chain, the footplate of the stapes or a membrane which closes the round window or an artificial window in the cochlea, in the vestibulum or in the labyrinth (equilibrium organ), via a coupling arrangement which has a coupling element adapted to be connected to a preselected coupling site. The coupling element is provided with a positioning device for selective movement of the coupling element between an open position in which the coupling element is adapted to be engaged with and disengaged from the coupling site, and a closed position in which the coupling element in the implanted state is joined by force fit and/or form fit to the coupling site.

24 Claims, 6 Drawing Sheets

U.S. PATENT DOCUMENTS

| | | | | | |
|---|---|---|---|---|---|
| 5,411,467 | A | * | 5/1995 | Hortmann et al. | 600/25 |
| 5,554,096 | A | | 9/1996 | Ball | |
| 5,624,376 | A | | 4/1997 | Ball et al. | |
| 5,707,338 | A | | 1/1998 | Adams et al. | |
| 5,788,711 | A | | 8/1998 | Lehner et al. | |
| 5,941,814 | A | | 8/1999 | Lehner et al. | |
| 6,077,215 | A | | 6/2000 | Leysieffer | |
| 6,171,229 | B1 | * | 1/2001 | Kroll et al. | 600/25 |
| 6,390,970 | B1 | * | 5/2002 | Muller | 128/899 |

OTHER PUBLICATIONS

H.P. Zenner et al., Erste Implantationen Eines Vollständig Implantierbaren Elektronischen Hörsystems Bei Patienten Mit Innenohr–Schwerhörigkeit, HNO 1998, vol. 46, Oct. 1998, pp. 844–852.

Anthony J. Maniglia et al., Contactless Semi–Imlantable Electromagnetic Middle Ear Device for the Treatment of Sensorineural Hearing Loss, vol. 28, No. 1, Feb. 1995, pp. 121–141.

John M. Fredrickson et al., Ongoing Investigations into an Implantable Electromagnetic Hearing aid for Moderate to Severe Sensorineural Hearing Loss, vol. 28, No. 1, Feb. 1995, pp. 107–121.

Naoaki Yanagihara et al., Efficacy of the Partially Implantable Middle Ear Implant in Middle and Inner Ear Disorders, Adv. Audiol., vol. 4, Karger, Basel 1988, pp. 149–159.

Jun–Ichi Suzuki et al., Implantation of Partially Implantable Middle Ear Implant and the Indication, Adv. Audiol., vol. 4, Karger, Basel 1988, pp. 160–166.

Dennis I. Bojrab, M.D., et al., Ossiculoplasty with Composite Prostheses, Overview and Analysis, Otolaryngologic Clinics of North America, vol. 27, No. 4, (1994), pp. 759–776.

* cited by examiner

Fig. 1
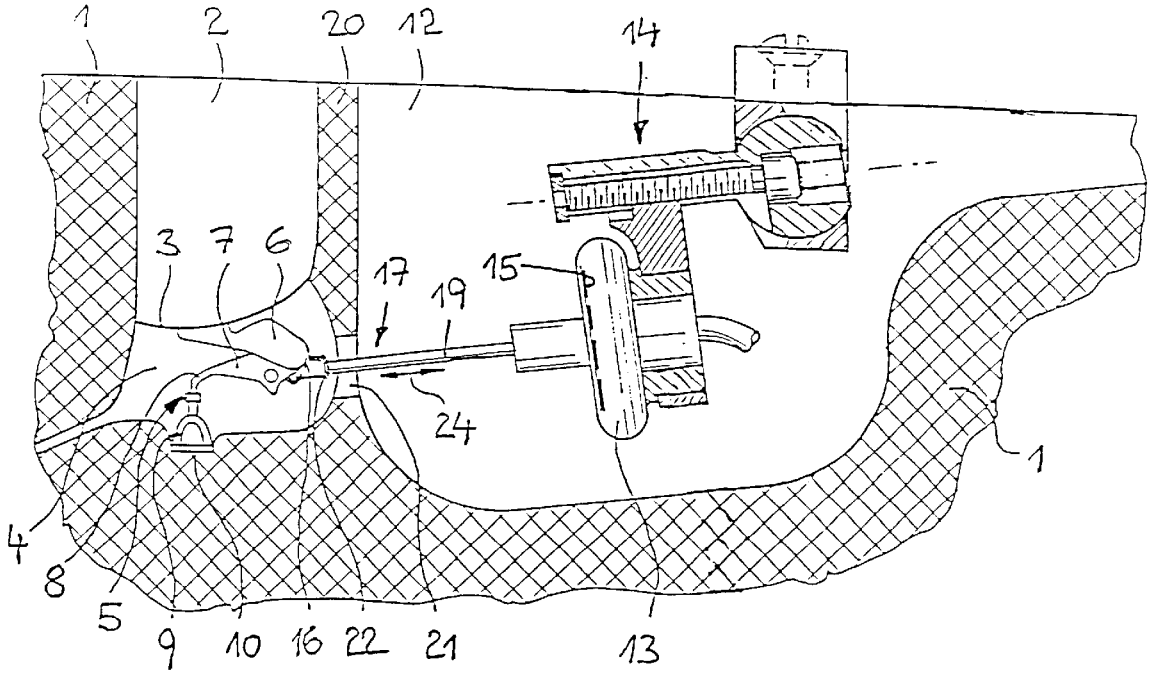
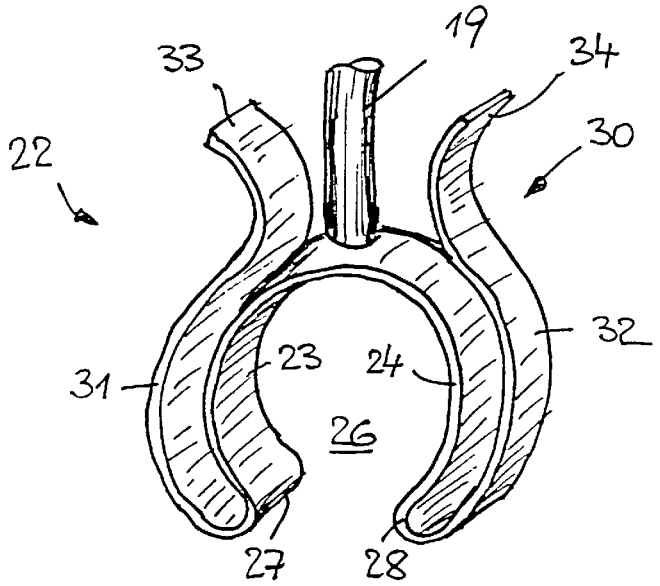
Fig. 2

Fig. 5
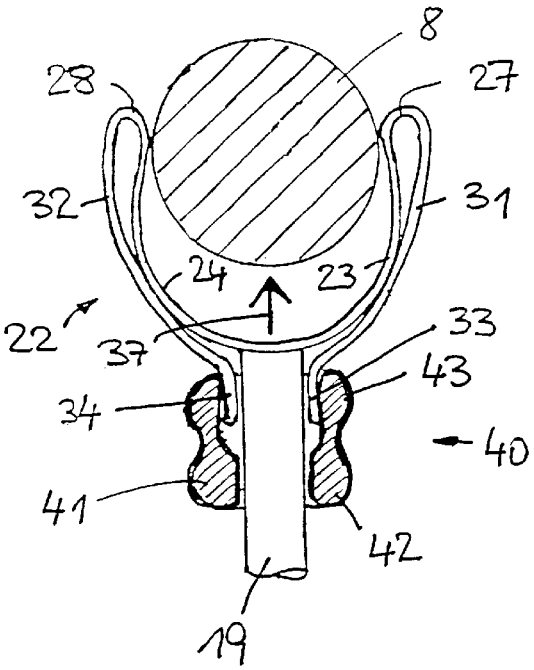
Fig. 6
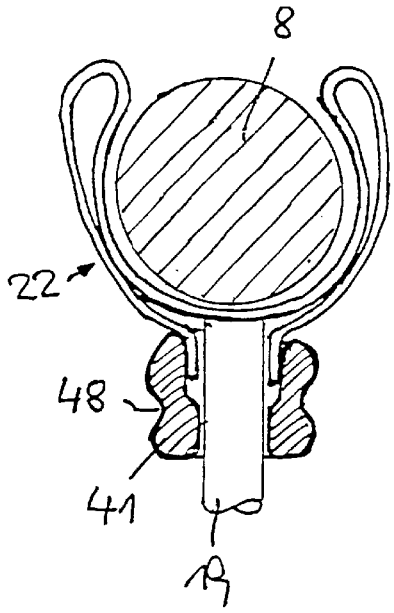
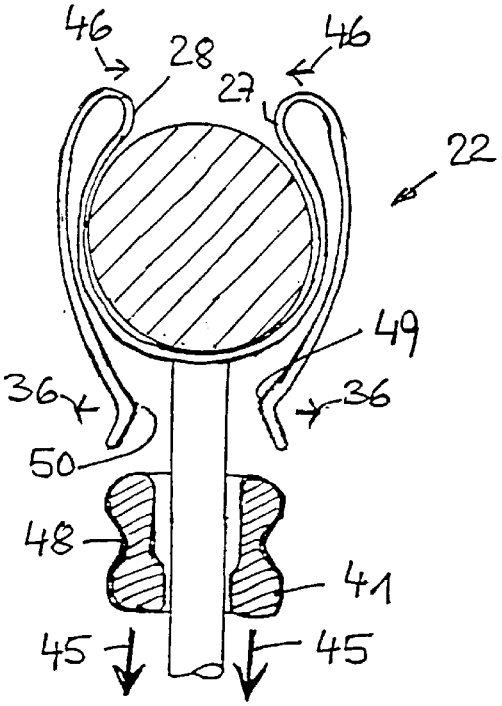
Fig. 7
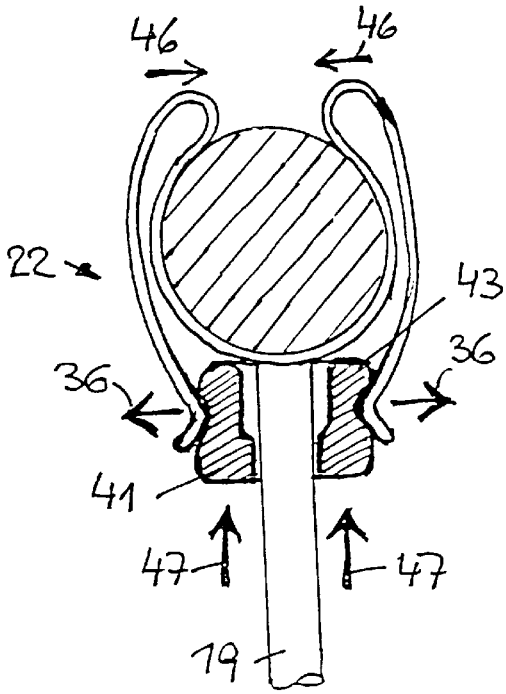
Fig. 8

Fig. 9
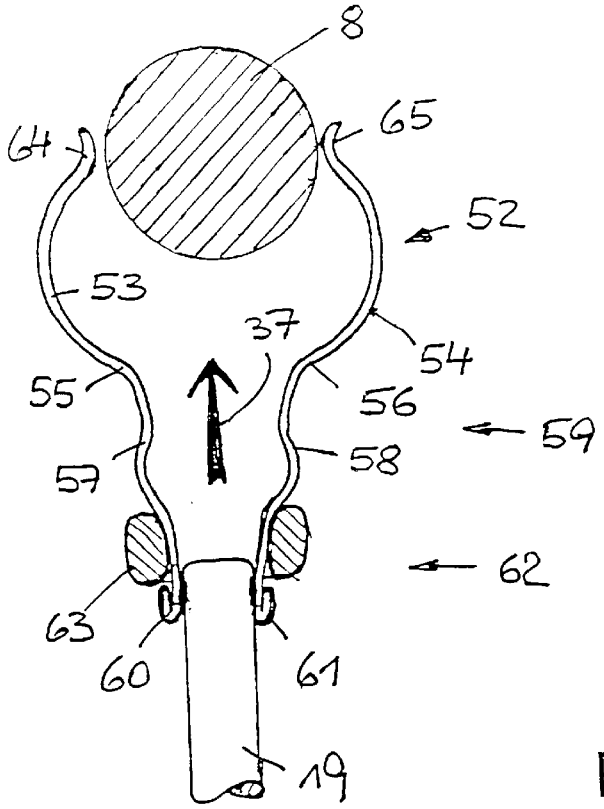
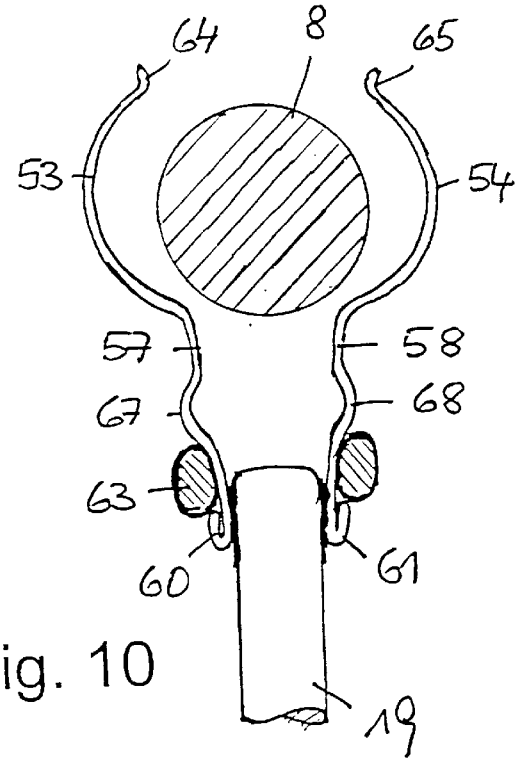
Fig. 10
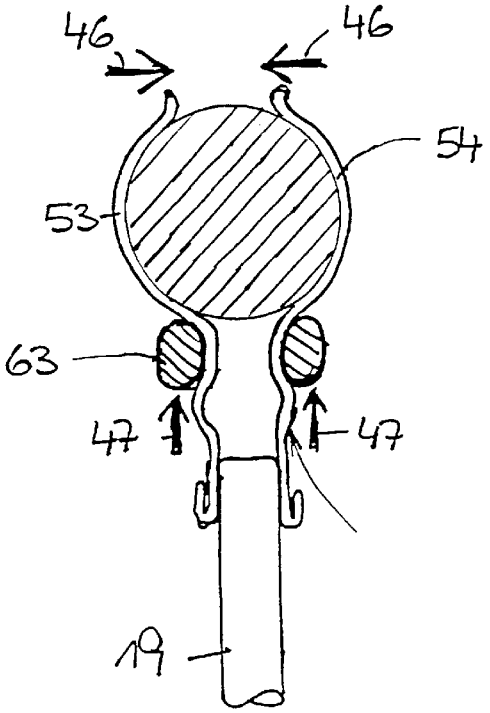
Fig. 11

ARRANGEMENT FOR MECHANICAL COUPLING OF A DRIVER TO A COUPLING SITE OF THE OSSICULAR CHAIN

BACKGROUND OF THE INVENTION

1. Field of the Invention

The invention relates to an implantable arrangement for mechanical coupling of an output-side driver part of a hearing system, the driver part having a capacity to be excited to mechanical vibrations, to a preselected coupling site on the ossicular chain, the footplate of the stapes or the membrane which closes the round window or an artificial window in the cochlea, in the vestibulum or in the labyrinth (equilibrium organ), via a coupling arrangement which has a coupling element which can be connected to a preselected coupling site.

2. Description of Related Art

Partially implantable or fully implantable hearing systems for direct mechanical stimulation are known. In these hearing systems the acoustic signal is converted into an electrical signal by means of a converter (microphone) and is amplified in an electronic signal processing stage; this amplified electrical signal is supplied to an implanted electromechanical converter the output-side mechanical vibrations of which are supplied directly, i.e. with direct mechanical contact, to the middle ear or inner ear. This applies regardless of whether pure labyrinthine deafness with a completely intact middle ear or combined deafness (middle ear and inner ear damaged) is to be rehabilitated. Therefore implantable electromechanical converters and processes for direct coupling of the mechanical converter vibrations to the intact middle ear or to the inner ear, respectively, for rehabilitation of pure labyrinthine deafness and also to the remaining ossicles of the middle ear in an artificially or pathologically altered middle ear for care of conductive deafness and their combinations have been described in the more recent scientific and patent literature.

Basically all physical conversion principles can be used as electromechanical converter processes, such as electromagnetic, electrodynamic, magnetostrictive, dielectric, and piezoelectric. In recent years various research groups have focussed essentially on two of these processes: electromagnetic and piezoelectric. An outline of these converter versions can be found in Zenner and Leysieffer (HNO 1997 Vol. 45, 749–774).

In the piezoelectric process, mechanically direct coupling of the outputside converter vibrations to the middle ear ossicle or directly to the oval window is necessary. In the electromagnetic principle the force coupling on the one hand can take place via an air gap ("contactless"), i.e. only a permanent magnet is placed by permanent fixation in direct mechanical contact with a middle ear ossicle. On the other hand, it is possible to dispose the entire converter within a housing (the coil and the magnet being coupled with the smallest possible air gap) and to transfer the output-side vibrations via a mechanically stiff coupling element with direct contact to the middle ear ossicle (Leysieffer et al. 1997 (HNO 1997, Vol. 45. pp. 792–800).

The patent literature contains some of the aforementioned versions of both electromagnetic and also piezoelectric hearing aid converters: U.S. Pat. No. 5,707,338 (Adams et al.), WO 98/06235 (Adams et al.), WO 98/06238 (Adams et al.), WO 98/06236 (Kroll et al.), WO 98/06237 (Bushek et al.), U.S. Patent No. 5,554,096 (Ball), U.S. Pat. No. 3,712,962 (Epley), U.S. Pat. No. 3,870,832 (Fredrickson), U.S. Pat. No. 5,277,694 (Leysieffer et al.), commonly owned U.S. patent application Ser. Nos. 09/275,872 and 09/311,563 (Leysieffer), U.S. Pat. No. 5,015,224 (Maniglia), U.S. Pat. No. 3,882,285 (Nunley) and U.S. Pat. No. 4.850,962 (Schaefer).

The partially implantable piezoelectric hearing system of the Japanese group of Suzuki and Yanigahara presupposes for implantation of the converter the absence of the middle ear ossicles and an empty tympanic cavity in order to be able to couple the piezoelement to the stapes (Yanigahara et al.: Efficacy of the partially implantable middle ear implant in middle and inner ear disorders. Adv. Audiol., Vol. 4, Karger Basel (1988), pp. 149–159; Suzuki et al.: Implantation of partially implantable middle ear implant and the indication. Adv. Audiol., Vol. 4, Karger Basel (1988), pp. 160–166). Similarly, in the process of a partially implantable hearing system for those suffering from labyrinthine deafness according to U.S. Pat. No. 4,850,962 (Schaefer) basically the incus is removed in order to be able to couple a piezoelectric converter element to the stapes. This also applies especially to other developments which are based on Schaefer technology and which are documented in the aforementioned patents (U.S. Pat. No. 5,707,338, WO 98/06235, WO 98/06238, WO 98/06236 and WO 98/06237).

Conversely, the electromagnetic converter of BALL ("Floating Mass Transducer FMT", U.S. Pat. Nos. 5,624,376 and 5,554,096) is fixed with titanium clips directly on the long process of the incus when the middle ear is intact. The electromagnetic converter of the partially implantable system of FREDRICKSON (Fredrickson et al.: Ongoing investigations into an implantable electromagnetic hearing aid for moderate to sever sensorineural hearing loss. Otolaryngologic Clinics of North America, Vol. 28/1 (1995), pp. 107–121) is mechanically coupled directly to the body of the incus when the ossicular chain of the middle ear is likewise intact. The same applies to the piezoelectric and electromagnetic converters of LEYSIEFFER (Leysieffer et al.: An implantable piezoelectric hearing aid converter for patients with labyrinthine deafness. HNO 1997/45, pp. 792–800, U.S. Pat. No. 5,277,694, U.S. patent application Ser. No. 09/275,872 and U.S. patent application Ser. No. 09/311,563). In the electromagnetic converter system of MANIGLIA (Maniglia et al: Contactless semi-implantable electromagnetic middle ear device for the treatment of sensorineural hearing loss, Otolaryngologic Clinics of North America, Vol. 28/1 (1995), pp. 121–141) when the ossicular chain is intact a permanent magnet likewise is permanently fixed mechanically to the ossicular chain, however, is mechanically driven via an air gap coupling by a coil.

In the described converter and coupling versions basically two implantation principles can be distinguished:

a) In the case of the one principle the electromechanical converter with its active converter element is located itself in the middle ear region in the tympanic cavity and there the converter is directly connected to an ossicle or the inner ear (U.S. Pat. Nos. 4,850,962, 5,015,225, 5,707,338, WO 98/06235, WO 98/06238, WO 98/06236, WO 98/06237, U.S. Pat. Nos. 5,624,376 and 5,554,096).

b) In the other principle the electromechanical converter with its active converter element is located outside of the middle ear region in an artificially formed mastoid cavity; the output-side mechanical vibrations are then transmitted to the middle or inner ear by means of mechanically passive coupling elements via suitable surgical accesses (natural aditus ad antrum, opening of the chorda-facialis angle or via an artificial hole from the mastoid) (Fredrickson et al.: Ongoing investigations into an implantable electromagnetic hearing aid for moderate to severe sensorineural hearing loss. Otolaryngologic Clinics of North America, Vol. 28/1 (1995), pp. 107–121; U.S. Pat. No. 5,277,694; U.S. patent applications Ser. Nos. 09/275,872 and 09/311,563).

In version a) the converter can be made as a so-called "floating mass" converter, i.e. the converter element does not require any "reactio" via secure screwing to the skull bone, but it vibrates based on the laws of mass inertia with its converter housing and transmits these vibrations directly to a middle ear ossicle (U.S. Pat. Nos. 5,624,376, 5,554,096, 5,707,338 and WO 98/06236). On the one hand, this means that an implantable fixation system on the cranial vault can be advantageously omitted and on the other hand, this version disadvantageously means that bulky artificial elements must be placed in the tympanic cavity and their long-term stability and biostability are currently not known or guaranteed, especially in the case of temporary pathological changes of the middle ear (for example, otitis media). Another major disadvantage consists in that the converter together with its electrical supply line has to be transferred from the mastoid into the middle ear and must be fixed there using suitable surgical tools; this requires expanded access through the chorda facialis angle and thus entails a latent hazard to the facial nerve which is located in the immediate vicinity.

In the converter versions as per b) the converter housing with the implantable positioning and fixation systems is attached to the cranial vault (advantageous embodiment U.S. Pat. No. 5,788,711). Both in the partially implantable system of FREDRICKSON (Ongoing investigations into an implantable electromagnetic hearing aid for moderate to severe sensorineural hearing loss. Otolaryngologic Clinics of North America, Vol. 28/1 (1995), pp. 107–121) as well as in the fully implantable hearing system of LEYSIEFFER and ZENNER (HNO 1998, vol. 46, 853–863 and 844–852) when the vibrating driver part is coupled to the body of the incus it is assumed for permanent and mechanically secure vibration transmission that the tip of the coupling rod which is placed in the laser-induced depression of the middle ear ossicle undergoes osseointegration over the long term, i.e. the coupling rod coalesces solidly with the ossicle and thus ensures reliable transmission of dynamic compressive and tensile forces. This long-term effect however is currently not yet scientifically proven or certain. Furthermore, in this type of coupling in case of a technical converter defect there is the disadvantage that decoupling from the ossicle to remove the converter can only be done with mechanically based surgical methods, this can mean considerable hazard to the middle ear and especially the inner ear.

The major advantage of these converter embodiments as per b) however is that the middle ear remains largely free and coupling access to the middle ear can take place without major possible hazard to the facial nerve. One preferable surgical process for this purpose is described in U.S. patent application Ser. No. 09/168,079. Basic advantageous forms of passive coupling elements for transmission of the output-side converter vibrations from the mastoid to the middle ear or inner ear are described in U.S. Pat. Nos. 5,277,694, 5,941,814 and in HNO 1998, Vol. 46, pp. 27–37—Lehner et al.: "Cold-flowing elements for coupling of an implantable hearing aid converter to the auditory ossicle or perilymph". The latter especially are coupling elements of gold, preferably soft-annealed fine gold, in the form of a C-band for the long process of the incus, a band loop for the long process of the incus and a tiny bell for the head of the stapes, and these coupling elements can be coupled using instruments which are standard in ear surgery and if necessary they can also be detached again.

In addition to the active hearing systems described above, passive hearing systems are also known in the form of prostheses as total replacement (TORP=total ossicular replacement prosthesis) or as partial replacements (PORP=partial ossicular replacement prosthesis) for the ossicular chain (D. I. Bojrab et al. "Ossiculoplasty with composite prostheses" in Otolaryngologic Clinics of North America, Vol. 27, No. 4, 1994, pp. 759–776). In these passive systems the eardrum forms the output-side driver part.

SUMMARY OF THE INVENTION

The object of this invention is to devise an implantable arrangement for mechanical coupling of an output-side driver part of a hearing system, the driver part having a capacity to be excited to mechanical vibrations, which implantable arrangement can be applied especially easily and reliably, which minimizes the necessary risky effort during implantation in the inner ear, and which under certain circumstances also allows for easy decoupling which may become necessary later.

Starting from a device of the type which is known from U.S. Pat. No. 5,941,814 and HNO Vol. 46, pp. 27–37, i.e. an implantable arrangement for mechanical coupling of an output-side driver part of a hearing system, the driver part having a capacity to be excited to mechanical vibrations, to a preselected coupling site on the ossicular chain, the footplate of the stapes or a membrane which closes the round window or an artificial window in the cochlea, in the vestibulum or in the labyrinth (equilibrium organ), via a coupling arrangement which has a coupling element adapted to be connected to a preselected coupling site, this object is achieved in accordance with the invention by providing the coupling element with a positioning device for selective movement of the coupling element between an open position in which the coupling element can be engaged to and disengaged from the coupling site, and a closed position in which the coupling element in the implanted state is joined by force fit and/or form fit to the coupling site.

The arrangement according to the invention provides for secure mechanical coupling and optionally decoupling of the output-side driver part especially easily and likewise reliably to highly impact-sensitive and pressure-sensitive structures of the middle ear. Coupling and decoupling processes can be carried out quickly and unerringly without endangering the ossicular chain.

In conformity with a further development of the invention the design is such that the coupling element in the open position can be engaged with and disengaged from the coupling site essentially without the action of force.

The coupling element can be made preferably as a clamp, especially a spring clamp, with at least two clamp elements which abut onto the coupling site in the closed position, with a mutual distance which can be selectively changed by means of the positioning device.

The positioning device can have positioning arms which engage the clamp elements and which can be activated to move the coupling element selectively between the open position and the closed position.

Preferably a locking device is provided by means of which the coupling element can be locked in the open position and/or the closed position.

The locking device can have a movably supported sliding part which interacts with the positioning arms. Advantageously the arrangement is furthermore equipped with means for preventing the sliding part from being lost.

Preferably the coupling element can be attached to a coupling rod which is drivingly connected to the output-side driver part. The sliding part can be supported for sliding movement on this coupling rod.

In one embodiment of the arrangement according to the invention the positioning arms engage the ends of the clamp elements remote from the coupling rod, the positioning arms extending at a distance essentially parallel to the clamp elements in the direction to the coupling rod and terminating in positioning ends, the mutual distance of which can be changed for moving the coupling element between the open position and the closed position.

The sliding part can advantageously be brought into a position in which it slides over the positioning ends of the positioning arms and fixes the positioning arms in a position in which the coupling element is in the open position. Preferably the sliding part can also be moved into a position in which it is disposed between the positioning ends of the positioning arms and fixes the positioning arms in a position in which the coupling element is in the closed position. In this embodiment the sliding part and the positioning ends of the positioning arms are preferably provided with catch means for locking the sliding part in a position which forces the coupling element into the closed position.

According to a modified embodiment of the arrangement according to the invention the positioning arms are connected to the ends of the clamp elements facing the coupling rod, and the mutual distance of the positioning arms can be changed to move the coupling element between the open position and the closed position. In this embodiment the other ends of the positioning arms are preferably connected to the coupling rod.

The positioning arms can be integrally connected to the associated clamp element; they can be biased into a position which corresponds to the open position of the coupling element and by means of the sliding part can be moved against the biasing into a position which corresponds to the closed position of the coupling element.

Advantageously the sliding part can be locked selectively in a catch position which corresponds to the open position of the coupling element and a catch position which corresponds to the closed position of the coupling element in order to reliably preclude unintentional movements of the coupling element. In this embodiment the positioning arms can be designed for locking the sliding part selectively in one or the other catch position. Alternatively, at least one locking spring may can be provided for locking the sliding part selectively in one or the other catch position.

The arrangement according to the invention can be part of an active hearing system in which the output-side driver is part of an electromechanical hearing aid converter. The arrangement according to the invention can however also be part of a passive hearing system, especially of a partial or full middle ear prosthesis in which in the implanted state the eardrum is used as the output-side driver part.

These and further objects, features and advantages of the present invention will become apparent from the following description when taken in connection with the accompanying drawings which, for purposes of illustration only, show several embodiments in accordance with the present invention.

BRIEF DESCRIPTION OF THE DRAWINGS

FIG. 1 shows on a larger scale in schematic form an implanted hearing aid converter with the coupling rod coupled to the ossicular chain, FIG. 2 shows on a still larger scale a perspective representation of the coupling element which is connected to the coupling rod of the hearing aid converter shown in FIG. 1 for coupling the hearing aid converter to an ossicle, for example to the long process of the incus, FIGS. 9 to 11 are schematic illustrations showing the coupling of the coupling element according to another modified embodiment.

DETAILED DESCRIPTION OF THE INVENTION

Figure 3:
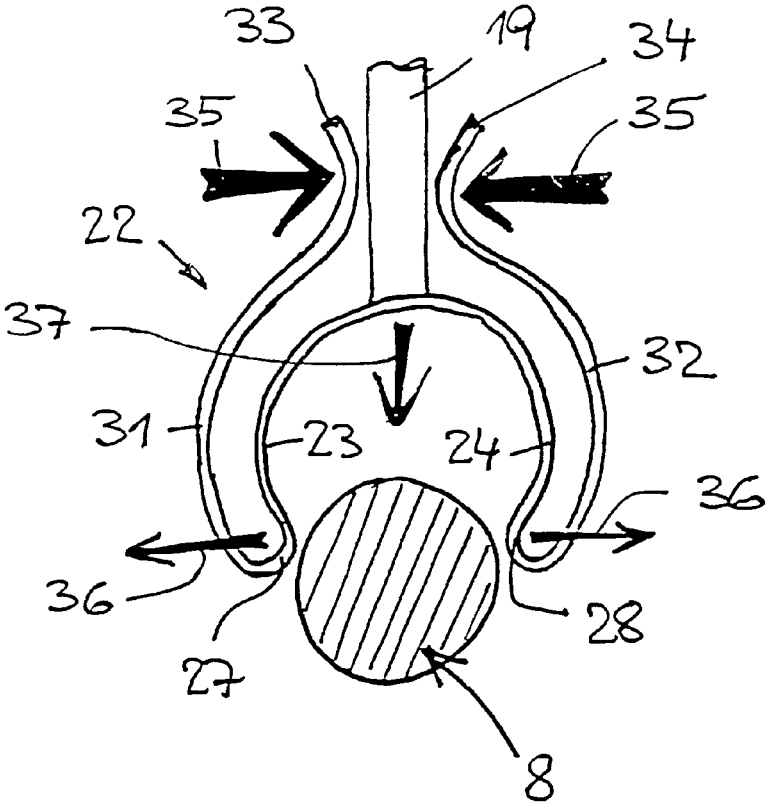
FIGS. 3 and 4 show schematic representations for coupling of the coupling element shown in FIG. 2, FIGS. 5 to 8 are schematic representations for coupling of a coupling element according to a modified embodiment.

FIG. 1 shows part of a human skull bone 1 with the auditory canal 2, the middle ear space (tympanic cavity) 4 which is separated therefrom by the eardrum 3, and the ossicular chain 5 which is located in the tympanic cavity. The ossicular chain 5 includes the malleus 6, the incus 7 with the long process 8 of the incus, and the stapes 9 with the footplate 10 of the stapes. In an artificial mastoid cavity 12 an electromechanical hearing aid converter 13 is fixed by means of a positioning and fixing system 14. The hearing aid converter 13 can be designed for example as a piezoconverter for vibratory stimulation of the ossicular chain, especially in the manner known from U.S. Pat. No. 5,277,694 and it is a component of an at least partially implantable and preferably fully implantable hearing aid, for example a hearing aid of the type known from HNO 1997 Vol. 45, pp. 749–774.

A vibration transmission path in the form of a biocompatible, mechanically passive coupling arrangement 17 is provided for mechanical coupling of an output-side driver part 15 of the hearing aid converter 13 from the mastoid side to a preselected coupling site 16 on the ossicular chain 5, for example to the process 8 of the incus. In FIG. 1 the driver part is shown only schematically, it can be excited to mechanical vibrations, and preferably is a vibratory membrane of this converter. The coupling arrangement is connected to the actively vibrational output-side driver part 15 and in the implanted state it abuts onto the coupling site 16 with a coupling end which is remote from the hearing aid converter 13. When an electrical voltage is applied to the hearing aid converter 13, the coupling arrangement 17 is caused to execute vibratory oscillations in the axial direction of the coupling arrangement by means of the output-side driver part 15. As a result, the electrically converted audio signals which are picked up by an input-side converter (microphone) (not shown) after electronic amplification in an electronic module of the active hearing system lead directly to mechanical deflections of the coupling arrangement 17. These deflections correspond to the acoustic information. The deflections of the coupling arrangement 17 are relayed to the ossicular chain 5 of the middle ear or to the stapes 9, the footplate 10 of the stapes or a membrane which is not shown and which closes the oval or round window or an artificial window in the cochlea, in the vestibulum or in the labyrinth (equilibrium organ). With the preprocessing electronic system being correspondingly designed, the deflections of the coupling arrangement thus cause an audiological amplification effect.

In this embodiment the coupling arrangement 17 has a coupling rod 19 which is mechanically joined securely to the output-side driver part 15 and which in this embodiment has essentially for its entire length the shape of a straight cylinder. In the implanted state the coupling rod 19 extends from the mastoid cavity 12 into the tympanic cavity 4 through a natural bone opening (aditus ad antrum) 21 which is located in the rear wall 20 of the auditory canal.

Figure 4:
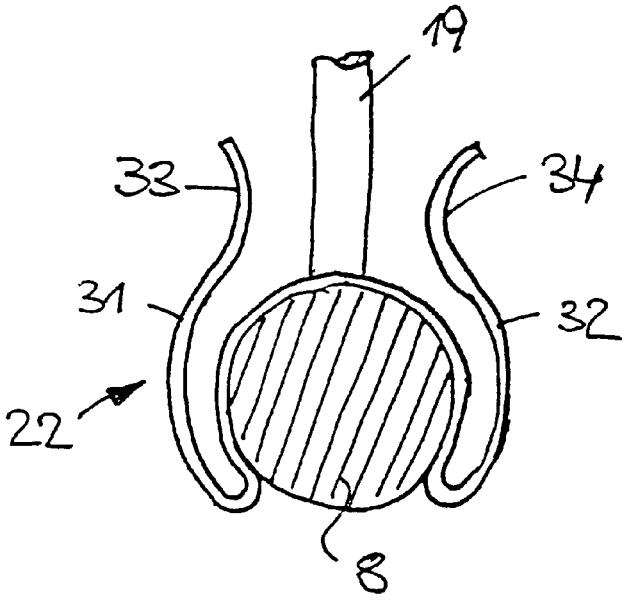

The coupling arrangement 17 furthermore includes a coupling element 22 which is shown in particular in FIGS. 2 to 4 and which is connected to the end of the coupling rod 19 which is remote from the hearing aid converter 13. In this embodiment the coupling element 22 is formed as a spring clamp with two elastic clamp elements 23, 24. In the implanted state the clamp elements 23 and 24 abut onto diametrically opposite sides of the target ossicle 8 in the region of the coupling site 16, preferably with slight spring bias. This provides for a dynamic tension-compression force coupling of the coupling element 22 and the target ossicle (in the illustrated case the long process 8 of the incus). In the illustrated embodiment the clamp elements 23 and 24 are designed such that they embrace the target ossicle 8 over a greater part of its circumference and provide for a force fit and/or form fit connection of the coupling arrangement 17 to the coupling site 16. In the relieved state they delimit a space 26 which corresponds roughly to the cross section of the target ossicle 8 at the coupling site 16.

The coupling element 22 can be moved by means of a positioning device 30, between an open position in which the coupling element can be freely engaged to and disengaged from the coupling site 16, and a closed position in which the coupling element in the implanted state is joined by force fit and/or form fit to the coupling site. The positioning device 30 has two positioning arms 31, 32 which are integrally joined to ends 27, 28 of the clamp elements 23 and 24 remote from the coupling rod 19. The positioning arms 31, 32 extend essentially in parallel to and outwardly spaced from the clamp elements 23 and 24, respectively, in the direction towards the coupling rod 19. They terminate in positioning ends 33 and 34 which are curved to the outside and which, in the relieved state, are positioned at a distance to one another to either side of the coupling rod 19.

If during the implantation process by means of a surgical instrument a force is applied to the positioning ends 33, 34 in the direction of arrows 35, i.e. essentially perpendicular to and in the direction towards the coupling rod, the ends 27, 28 of the clamp elements 23 and 24 remote from the coupling rod 19 are drawn apart as indicated by arrows 36 in FIG. 3 into the open position according to FIG. 3, preferably so far that the coupling element 22 does not touch the target ossicle 8 when pushed onto the latter (arrow 37 in FIG. 3). As a result, during the coupling process force is prevented from being unwantedly applied to the coupling site. When the coupling element 22 has reached the position illustrated in FIG. 4 on the target ossicle 8, the positioning ends 33, 34 are released. The positioning ends 33, 34 flex outwardly into their relieved position, and the clamp elements 23 and 24 abut onto the target ossicle 8 as a result of the spring restoring force. If necessary the coupling element 22 can be released again from the target ossicle 8 by again pressing on the positioning ends 33, 34 in the direction of the arrows 35.

In the embodiment shown in FIGS. 5 to 8, additionally a locking device 40 which makes it possible to lock the coupling element 22 both in the open position as shown in FIGS. 5 and 6 and also in the closed position as shown in FIG. 8 is associated with the coupling element 22. The locking device 40 has a sliding sleeve 41 which can be slidingly moved along the coupling rod 19. The inside diameter of the sliding sleeve 41 is staggered. Here a part 42 of the sliding sleeve 41 which is remote from the coupling element 22 has an inside diameter which is only slightly larger than the outside diameter of the coupling rod 19. A part 43 of the sliding sleeve 41 which faces the coupling element 22 has an inside diameter which is larger than the outside diameter of the coupling rod 19 by an amount allowing the sliding sleeve part 43 to be pushed onto the positioning ends 33, 34 of the positioning arms 31, 32 when the positioning ends are placed against the coupling rod 19 (FIGS. 5 and 6).

In the course of the implantation process the sliding sleeve 41 is pushed over the positioning ends 33, 34 of the positioning arms 31, 32. The ends 27, 28 of the clamp elements 23 and 24 remote from the coupling rod 19 thereby are drawn apart into the open position (FIG. 5). Then the coupling element 22 is moved in the direction of arrow 37 and is engaged with the target ossicle 8, as shown in FIG. 6. Then the sliding sleeve 41 on the coupling rod 19 is withdrawn in the direction of the arrows 45 from the positioning ends 33, 34 of the positioning arms 31, 32. The positioning ends flex outwardly (arrows 36 in FIG. 7) and the ends 27, 28 of the clamp elements 23, 24 move towards one another (arrows 46 in FIG. 7). The coupling element 22 is now in its closed position. In this position the coupling element 22 is locked by the sliding sleeve 41 being pushed towards the coupling elements 22 in the direction of arrows 47 (FIG. 8) and in doing so the part 43 of the sliding sleeve 41 is pressed between the positioning ends 33, 34 of the positioning arms 31, 32 as is shown in FIG. 8. The sliding sleeve 41 urges the positioning ends 33, 34 outwardly in the direction of the arrows 36; in this way it keeps the coupling element 22 closed. The sliding sleeve 41 is provided on the outside thereof with an annular groove 48. The positioning arms 31, 32 slip into this groove 48 with a catch projection 49 and 50, respectively. The sliding sleeve 41 is thus arrested in the locked position.

FIGS. 9 to 11 show a modified embodiment of a coupling element 52 with a spring clamp which has two clamp elements 53 and 54. The clamp elements 53, 54 at their ends 55, 56, respectively, facing the coupling rod 19, each are integrally joined to a positioning arm 57 and 58, respectively, of a positioning device 59. The positioning arms 57, 58 are oriented essentially in the axial extension of the coupling rod 19, and their ends 60, 61 remote from the clamp elements 23, 24 are attached to the end of the coupling rod 19 facing the coupling element. There is provided a locking device 62 comprising an elastically extensible sliding ring 63 which fits around the positioning arms 57, 58 and which can be pushed along the positioning arms.

In the open position of the coupling element 52 which is illustrated in FIGS. 9 and 10, the sliding ring 63 is located near the ends 60, 61 of the positioning arms 57, 58 facing the coupling rod. These ends are folded outwardly and in this way protect the sliding ring 63 from being lost. The positioning arms 57, 58 are biased into a position corresponding to the open position of the coupling element 52. In this position the coupling element 52 can be pushed onto the target ossicle 8 (arrow 37 in FIG. 9) without free ends 64, 65 of the clamp elements 53 and 54, respectively, touching the target ossicle 8 or an optionally provided intermediate layer (not shown). After the coupling element 52 is moved into the position shown in FIG. 10, the sliding ring 63 is advanced along the positioning arms 57, 58 (arrow 47 in FIG. 11) to near the clamp elements 53, 54. The sliding ring 63 presses the positioning arms 57, 58 together. In this way the clamp elements 53 and 54 are moved into a position which corresponds to the closed position of the coupling element 52 (arrows 46 in FIG. 11). Unwanted displacements of the sliding ring 63 are prevented by bulges 67, 68 of the positioning arms 57, 58. When the coupling element 52 is in the open position (FIGS. 9 and 10) the sliding ring 63 which is under a certain pretension is kept in the axial direction between the bent ends 60, 61 and the bulges 67, 68 of the positioning arms 57, 58. In the closed position of the coupling element 52 (FIG. 11) the bulges 67, 68 of the positioning arms 57, 58 in interaction with the clamp elements 53 and 54 which outwardly project from the positioning arms 57, 58 prevent unintentional axial movement of the sliding ring 63.

Figure 12:
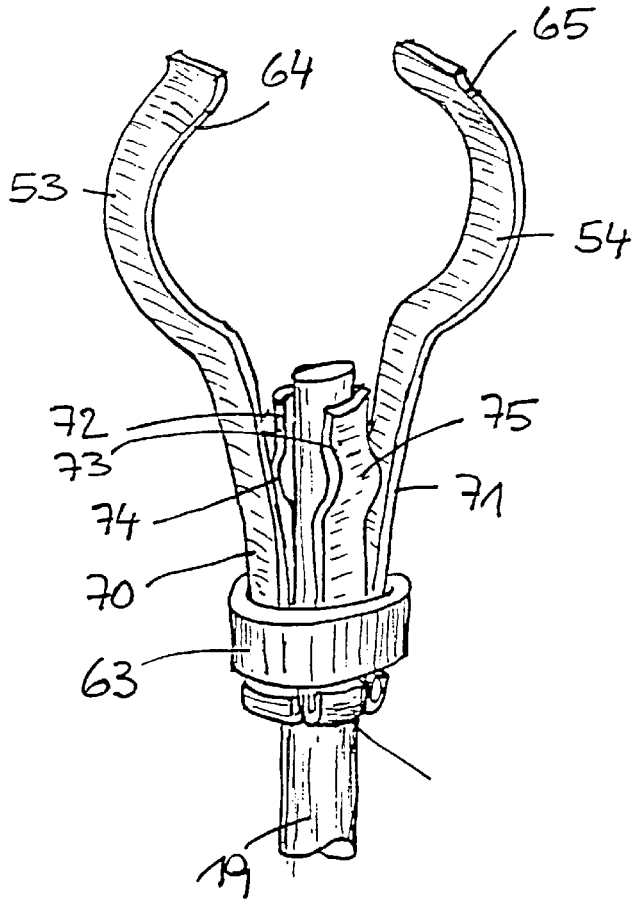
FIGS. 12 and 13 show perspective representations of another embodiment of the coupling element in accordance with the invention.
Figure 13:
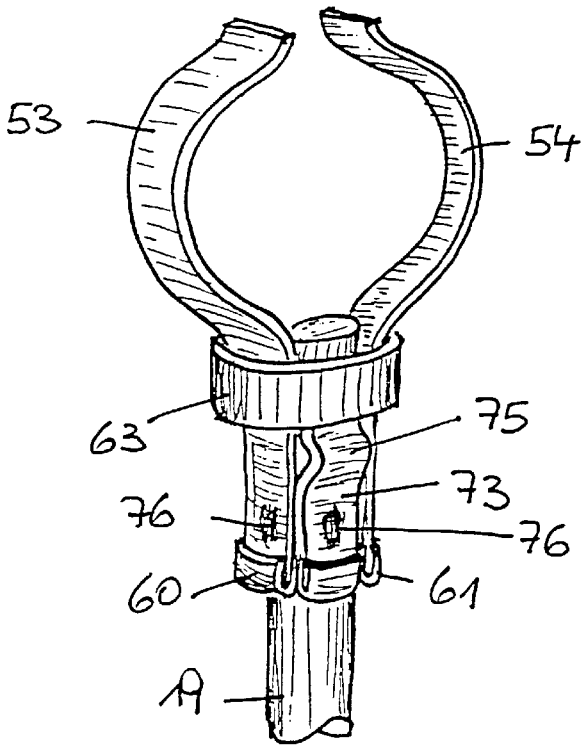

The embodiment shown in FIGS. 12 and 13 differs from that of FIGS. 9 to 11 essentially only in that there are positioning arms 70, 71 without bulges 67, 68 and that the arrangement is provided with additional locking springs 72, 73 for locking the sliding ring 63. The locking springs 72, 73 are provided with bulges 74, 75 which functionally correspond to the bulges 67, 68. While furthermore in the arrangement of FIGS. 9 to 11 the coupling rod 19 extends only into the vicinity of the bent positioning arm ends 60, 61, the coupling rod 19 in the case of the embodiment of FIGS. 12 to 13 extends to near the clamp elements 53 and 54. In FIG. 13 weld joints between the coupling rod 19 and the positioning arms 70, 71 and the locking springs 72, 73 are indicated at 76.

Figure 14:
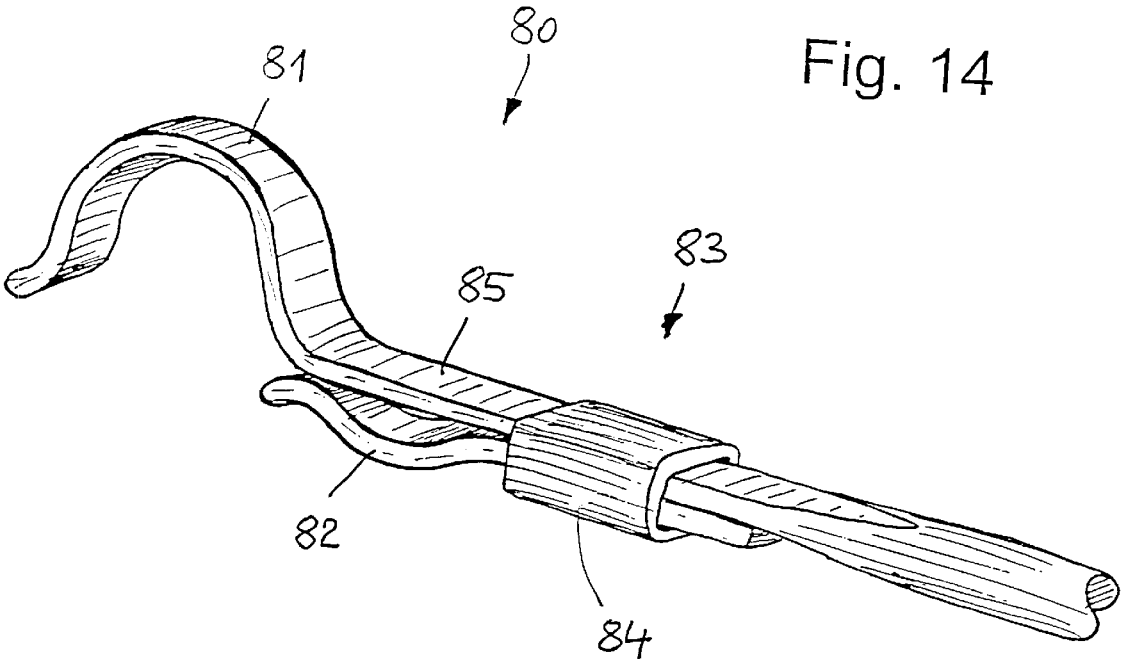
FIGS. 14 and 15 show perspective representations of another embodiment of the coupling element in accordance with the invention in the open and closed position, respectively.
Figure 15:
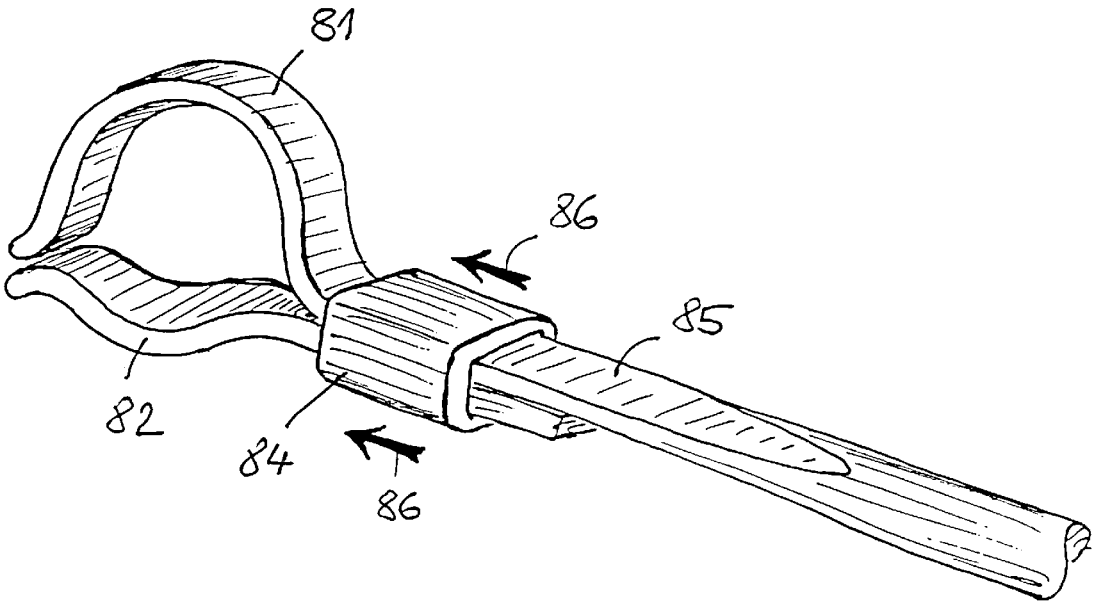

The embodiment illustrated in FIGS. 14 and 15 comprises a coupling element 80 with two elastic clamp elements 81 and 82 and a positioning device 83. The positioning device 83 has a sliding sleeve 84 which is securely joined to the one clamp element 82 and which can be moved lengthwise on a projection 85 of the other clamp element 81. The clamp element 81 is joined to the coupling rod 19 in a manner which is not shown in further detailed. Optionally the clamp element 81 can be an integral part of the coupling rod. During implantation, the clamp element 81 is engaged with the target ossicle, while the sliding sleeve 84 together with the clamp element 82 is located in the open position shown in FIG. 14. Then the sliding sleeve 84 together with the clamp element 82 is advanced in the direction of arrows 86 into the closed position which is shown in FIG. 15 and in which the clamp elements 81, 82 embrace the target ossicle.

The coupling rod may be made of any known biocompatible metal or metal alloy, particularly implantable titanium, especially pure titanium with a purity of more than 99.6%. In addition, among others platinum, niobium, or tantalum or alloys of titanium, platinum, niobium or tantalum are suited. Optionally the coupling rod 19 can however also consist of an implantable ceramic material, especially aluminum oxide. The coupling elements and especially the clamp elements, the positioning arms and the locking springs can be made of the same metals and metal alloys as the coupling rod. Furthermore, long-term implantable plastics can be used for manufacturing the coupling rod and the coupling elements, such as, among others, silicones, polyurethanes, PTFE, FEP, polycarbonates and the like which optionally can be fiber reinforced, especially carbon fiber reinforced.

While various embodiments in accordance with the present invention have been shown and described, it is understood that the invention is not limited thereto, and is susceptible to numerous changes and modifications as known to those skilled in the art. Therefore, this invention is not limited to the details shown and described herein, and includes all such changes and modifications as are encompassed by the scope of the appended claims.

What is claimed is:

1. Implantable arrangement for mechanical coupling of a mechanically vibratable output-side driver part of a hearing system to a preselected coupling site selected from the group consisting of the ossicle chain, the, footplate of the stapes the membrane which closes the round window, an artificial window in the cochlea, in the vestibulum and in the labyrinth of a patient via a coupling arrangement, said coupling arrangement being connectable to said preselected coupling site and comprising, at least two coupling elements connected in a predetermined, spaced apart position relative to each other when disengaged from the preselected coupling site and an actuating device for selective movement of at least one of the coupling elements relative to the other coupling element between an open position in which the coupling arrangement is engageable on and disengageable from the preselected coupling site, and a closed position in which the coupling arrangement, in an implanted state, is joined to the preselected coupling site.

2. Arrangement as claimed in claim 1, wherein the at least two coupling elements, in the open position, are dimensioned for engagement on the coupling site essentially without the action of force on the preselected coupling site.

3. Arrangement as claimed in claim 1, wherein the coupling arrangement is a clamp and said coupling elements comprise at least two clamp elements which adjoin the preselected coupling site when in the closed position.

4. Arrangement as claimed in claim 3, wherein the at least two clamp elements are dimensioned be a predetermined distance from each other when disengaged from the preselected coupling site wherein the predetermined distance is selectively changeable by means of the actuating device.

5. Arrangement as claimed in claim 3, wherein the at least two clamp elements are movable relative to each other by means of the actuating device.

6. Arrangement as claimed in claim 3, wherein the coupling arrangement has at least two elastic clamp elements.

7. Arrangement as claimed in claim 3, wherein the actuating device has positioning arms which engage the clamp elements and which move the at least two clamp elements selectively between the open position and the closed position.

8. Arrangement as claimed in claim 7, further comprising a coupling rod which is drive-connected to the output-side driver part and to which an end of the coupling arrangement is attached; and wherein the positioning arms engage ends of the clamp elements which are positioned opposite the end of the coupling arrangement which is attached to the coupling rod and extend in essentially a spaced, parallel relation to the clamp elements in a direction toward the coupling rod, wherein the positioning arms terminate in positioning ends which are mutually spaced apart a distance which is changeable for moving the coupling arrangement between the open position and the closed position.

9. Arrangement as claimed in claim 8, further comprising a locking device with which the coupling arrangement is lockable in at least one of said open position and said closed position, wherein the locking device has a movably supported sliding part which interacts with the positioning arms and wherein the sliding part is movable into a position in which it overlies the positioning ends of the positioning arms and fixes the positioning arms in a position in which the coupling arrangement is in the open position.

10. Arrangement as claimed in claim 9, wherein the sliding part is movable into a position in which it lies between the positioning ends of the positioning arms and fixes the positioning arms in a position in which the coupling arrangement is in the closed position.

11. Arrangement as claimed in claim 10, wherein the sliding part and the positioning ends of the positioning arms are provided with catch means for locking the sliding part in a position which forces the closed position of the coupling arrangement.

12. Arrangement as claimed in claim 8, wherein the positioning arms are joined in one piece to the clamp arrangement.

13. Arrangement as claimed in claim 7, further comprising a coupling rod which is drive-connected to the output-side driver part and to which the coupling arrangement is attached; and wherein the positioning arms are connected to the ends of the clamp elements facing the coupling rod such that a mutual, spaced apart distance of the positioning arms can be changed to move the coupling arrangement between the open position and the closed position.

14. Arrangement as claimed in claim 13, wherein an opposite end of each of the positioning arms is connected to the coupling rod.

15. Arrangement as claimed in claim 13, further comprising a locking device with which the coupling arrangement is lockable in at least one of said open position and said closed position wherein the locking device has a movably supported sliding part which interacts with the positioning arms; and wherein the positioning arms are pre-tensioned into a position which corresponds to the open position of the coupling arrangement and by means of the sliding part are movable against the pre-tensioning into a position which corresponds to the closed position of the coupling arrangement.

16. Arrangement as claimed in claim 15, wherein the sliding part is selectively lockable in a catch position which corresponds to the open position of the coupling arrangement and a catch position which corresponds to the closed position of the coupling arrangement.

17. Arrangement as claimed in claim 16, wherein the positioning arms are selectively lockable by the sliding part in each catch position.

18. Arrangement as claimed in claim 15, wherein at least one locking spring is provided for selectively locking the sliding part in each catch position.

19. Arrangement as claimed in claim 1, further comprising a locking device with which the coupling arrangement is lockable in at least one of said open position and said closed position.

20. Arrangement as claimed in claim 19, wherein the actuating device has positioning arms which engage the at least two coupling elements and which are actuatable to move the at least two coupling elements selectively between the open position and the closed position; and wherein the locking device has a movably supported sliding part which interacts with the positioning arms.

21. Arrangement as claimed in claim 20, further comprising means for preventing loss of the sliding part.

22. Arrangement as claimed in claim 20, further comprising a coupling rod which is drive-connected to the output-side driver part and to which the coupling arrangement is attached wherein the sliding part is movably supported on the coupling rod.

23. Arrangement as claimed in claim 1, further comprising a coupling rod which is drive-connected to the output-side driver part and to which the coupling arrangement is attached.

24. Arrangement as claimed in claim 1, wherein the implantable arrangement is part of an active hearing system in which the output-side driver is part of an electromechanical hearing aid converter.

* * * * *